US010473335B2

(12) United States Patent
Nemes et al.

(10) Patent No.: US 10,473,335 B2
(45) Date of Patent: Nov. 12, 2019

(54) CONCEALABLE ELECTRIC FIREPLACE INSERT

(71) Applicant: Twin-Star International, Inc., Delray Beach, FL (US)

(72) Inventors: Tyler Nemes, Boynton Beach, FL (US); Joseph Benedetti, Nashville, TN (US)

(73) Assignee: TWIN-STAR INTERNATIONAL, INC., Delray Beach, FL (US)

( * ) Notice: Subject to any disclaimer, the term of this patent is extended or adjusted under 35 U.S.C. 154(b) by 848 days.

(21) Appl. No.: 14/869,408

(22) Filed: Sep. 29, 2015

(65) Prior Publication Data

US 2017/0089587 A1 Mar. 30, 2017

(51) Int. Cl.
*F24C 7/00* (2006.01)

(52) U.S. Cl.
CPC ..... *F24C 7/004* (2013.01)

(58) Field of Classification Search
CPC ..... F24C 7/004; F24C 15/007; F24C 15/06; F24C 15/08; F24C 15/18; F24C 15/36; F24B 1/181; F24B 1/192
USPC ..... 392/347–385
See application file for complete search history.

(56) References Cited

U.S. PATENT DOCUMENTS 6,919,884 B2 * 7/2005 Mix ..... F24B 1/1808 345/204

FOREIGN PATENT DOCUMENTS

WO WO 2008148717 A2 * 12/2008 ..... F24C 7/004

* cited by examiner

*Primary Examiner* — Dana Ross
*Assistant Examiner* — Joe E Mills, Jr.
(74) *Attorney, Agent, or Firm* — McDonald Hopkins LLC

(57) ABSTRACT

A combined furniture and heating device having a concealable electric fireplace insert installed within a fireplace compartment of a furniture apparatus is provided. The electric fireplace insert has a front surface from which simulated flames are viewable when an opening of the fireplace compartment is uncovered so that the furniture apparatus is configured in its open configuration. The furniture apparatus includes a concealing panel removably installable over the opening configure the device in a concealed configuration so that the electric fireplace insert and its simulated flames viewable at its front surface are at least partially concealed. Power to a heating apparatus of the electric fireplace insert is turned on and off by a disabling device as the concealing panel is alternated between the open and concealed configurations. The disabling device can include a switch or a thermistor.

33 Claims, 10 Drawing Sheets

CONCEALABLE ELECTRIC FIREPLACE INSERT

FIELD OF THE INVENTION

The invention relates to an electric fireplace. More particularly, the invention relates to a concealable fireplace insert for an electric fireplace installed within a furniture apparatus.

BACKGROUND

Fireplaces are commonly found in homes of colder climates. Fireplaces often improve the aesthetics of a room in which they are located. Electric and gas fireplaces are also commonly used in homes, apartments, and condominiums as well as in commercial settings such as restaurants, hotels, offices, and other places of business. Fireplaces, including electric and gas fireplaces, presently are not concealable from view when not in use.

What is needed is an electric fireplace with a removable and/or replaceable cover for concealing an electric fireplace insert of an electric fireplace. A further need exists for an electric fireplace insert that is capable of being concealed so as to blend in with the décor of a room, wherein the electric fireplace insert is operable when configured in an unconcealed, open configuration and inoperable when configured in a closed or covered, concealed configuration.

SUMMARY

The present invention advantageously provides a combined furniture and heating device that includes an electric fireplace with a removable and/or replaceable cover for concealing (when desired) an electric fireplace insert that is installed inside a furniture apparatus. The furniture apparatus can be a furniture or furniture-type piece. The furniture apparatus may also include components or design elements that form a mantle and frame or trim of the electric fireplace and advantageously provides an electric fireplace insert that is concealable to blend in with the décor of a room. The cover can be a door, a removable wall or panel, a movable (e.g., sliding or swinging panel), or other suitable cover for placing over an opening of a fireplace compartment of the furniture apparatus so as to conceal the electric fireplace that is installed inside and whose front is visible through the opening of the fireplace compartment. For purposes of convenience, the cover is referred to herein as a concealing panel. When the concealing panel is installed or placed so as to cover the opening of the fireplace compartment, the furniture apparatus is configured in a concealed configuration. When the concealing panel is opened or removed from the opening of the fireplace compartment, the furniture apparatus is configured in an open configuration.

A heating apparatus of the electric fireplace insert can be operable when the furniture apparatus is configured in the open configuration and can be inoperable when the opening of the furniture apparatus is closed or covered in the concealed configuration. One or more sensors may be included in the device to detect whether the heating apparatus of the electric fireplace insert is operating while the cover is in an open or concealed configuration. The electric fireplace may include a disabling device capable of turning off power to the heating apparatus to prevent overheating and power usage when the furniture apparatus is configured in the concealed configuration and the electric fireplace insert is not being used.

Accordingly, the invention features a combined furniture and heating device that includes a furniture apparatus and a fireplace insert. The furniture apparatus includes a fireplace compartment formed within the furniture apparatus, an opening on at least one side of the furniture apparatus, and a concealing panel for configuring the furniture apparatus into an open configuration or a concealed configuration. The fireplace insert is installed within the fireplace compartment of the furniture apparatus. The fireplace insert includes a front surface at which flames are viewable when the concealing panel is placed in the open configuration. The concealing panel is removably installed proximal to the front surface of the fireplace insert and is alternately configurable in the concealed configuration to at least partially conceal the fireplace insert and the open configuration to reveal the front surface of the fireplace insert.

In another aspect, the invention can feature the fireplace insert being an electric fireplace insert and the flames being simulated.

In another aspect, the invention can feature a disabling device to turn on and turn off power to a heating apparatus that is located inside the fireplace insert.

In another aspect, the invention can feature the disabling device turning off power to the heating apparatus after the concealing panel is configured in the concealed configuration and turning on power to the heating apparatus after the concealing panel is configured in the open configuration.

In another aspect, the invention can feature the disabling device turning off power to the heating apparatus when a temperature increase above a first threshold is detected in the combined furniture and heating device and turning on power to the heating apparatus when a temperature decrease below a second threshold is detected in the combined furniture and heating device.

In another aspect, the invention can feature the disabling device including at least one thermistor for detecting the temperature increase above the first threshold and the temperature decrease below the second threshold.

In another aspect, the invention can feature the thermistor being a negative temperature coefficient (NTC) thermistor.

In another aspect, the invention can feature the first threshold being a specific or approximate first temperature level and the second threshold being a specific or approximate second temperature level.

In another aspect, the invention can feature the first threshold being a rate of temperature increase determined over a first interval of time and the second threshold being a rate of temperature decrease determined over a second interval of time.

In another aspect, the invention can feature the disabling device including a switch.

In another aspect, the invention can feature the switch including a contact switch, a magnetic proximity switch, or an optical switch.

In another aspect, the invention can feature the disabling device being located inside the furniture apparatus.

In another aspect, the invention can feature the disabling device being located inside the fireplace insert.

In another aspect, the invention can feature a computing device that stores data related to temperature measurements detected and recorded at periodic intervals by the disabling device and that calculates a rate of change, either increase or decrease, in temperature over an interval of time that includes at least some of the period intervals at which temperature measurements were detected and recorded, wherein the computing device is communicatively connected to the disabling device to receive information detected by the disabling device and transmitted to the computing device.

In another aspect, the invention can feature the furniture apparatus being a furniture item selected from among the group of: a media console or media cabinet, a television stand, a cabinet, a dresser, a bureau, a chest of drawers, a nightstand, a wardrobe cabinet, a bookcase, a desk, a credenza, a buffet cabinet, a china cabinet, a pantry cabinet, a chest, a trunk, a headboard of a bed, a footboard of a bed, or any other suitable furniture item comprising sufficient space within which the furniture compartment may be formed for containing the fireplace insert.

In another aspect, the invention can feature the concealing panel including at least one door attached to the furniture apparatus by one or more hinges and capable of closing to cover the opening so as to conceal the fireplace insert.

In another aspect, the invention can feature the concealing panel including at least one sliding door movable within at least one track installed on the furniture apparatus and capable of closing to cover the opening so as to conceal the fireplace insert.

In another aspect, the invention can feature the concealing panel including a removable panel that is capable of being placed over the opening so as to conceal the fireplace insert.

In another aspect, the invention can feature the concealing panel being constructed from materials and in colors that are the same as or that match the materials and colors of the furniture apparatus.

The invention also features a concealable electric fireplace system having a furniture apparatus, an electric fireplace insert, and a disabling device. The furniture apparatus includes a fireplace compartment formed within, an opening on at least one side of the furniture apparatus, and a concealing panel for configuring the furniture apparatus into an open configuration in which the opening is covered or a concealed configuration in which the opening is not covered. The electric fireplace insert is installed within the fireplace compartment of the furniture apparatus. The electric fireplace insert can include a front surface at which simulated flames are viewable when the concealing apparatus is placed in the open configuration. The disabling device turns on and turns off power to a heating apparatus that is located inside the electric fireplace insert. The concealing panel can be removably installed proximal to the front surface of the electric fireplace insert and can be alternately configurable in the concealed configuration to at least partially conceal the electric fireplace insert and in the open configuration to reveal the front surface of the electric fireplace insert.

In another aspect, the invention can feature the disabling device turning off power to the heating apparatus after the concealing panel is configured in the concealed configuration and turning on power to the heating apparatus after the concealing panel is configured in the open configuration.

In another aspect, the invention can feature the disabling device turning off power to the heating apparatus when a temperature increase above a first threshold is detected in the combined furniture and heating device and turning on power to the heating apparatus when a temperature decrease below a second threshold is detected in the combined furniture and heating device.

In another aspect, the invention can feature the disabling device including at least one negative temperature coefficient (NTC) thermistor for detecting the temperature increase above the first threshold and the temperature decrease below the second threshold.

In another aspect, the invention can feature a computing device that stores data related to temperature measurements detected and recorded at periodic intervals by the disabling device and that calculates a rate of change, either increase or decrease, in temperature over an interval of time comprising at least some of the period intervals at which temperature measurements were detected and recorded. The computing device is communicatively connected to the disabling device to receive information detected by the disabling device and transmitted to the computing device.

In another aspect, the invention can feature the furniture apparatus being a furniture item selected from among the following group: a media console or media cabinet, a television stand, a cabinet, a dresser, a bureau, a chest of drawers, a nightstand, a wardrobe cabinet, a bookcase, a desk, a credenza, a buffet cabinet, a china cabinet, a pantry cabinet, a chest, a trunk, a headboard of a bed, a footboard of a bed, and any other suitable furniture item comprising sufficient space within which the furniture compartment may be formed for containing the fireplace insert.

The invention also features a concealable electric fireplace system that includes a furniture apparatus, an electric fireplace insert, and a disabling device. The furniture apparatus includes a fireplace compartment formed within, an opening on at least one side of the furniture apparatus, and a concealing panel for configuring the furniture apparatus into an open configuration or a concealed configuration. The electric fireplace insert can be installed within the fireplace compartment of the furniture apparatus. The electric fireplace insert can include a front surface at which simulated flames are viewable when the concealing apparatus is placed in the open configuration. The disabling device can be installed inside the electric fireplace insert to turn on and turn off power to a heating apparatus that is located inside the electric fireplace insert. The disabling device can include at least one thermistor. The disabling device can turn off power to the heating apparatus when a temperature increase above a first threshold is detected by the at least one thermistor in the combined furniture and heating device and can turn on power to the heating apparatus when a temperature decrease below a second threshold is detected by the at least one thermistor in the combined furniture and heating device. The concealing panel can be removably installed proximal to the front surface of the electric fireplace insert and is alternately configurable in the concealed configuration to at least partially conceal the electric fireplace insert and in the open configuration to reveal the front surface of the electric fireplace insert.

In another aspect, the invention can feature a computing device that stores data related to temperature measurements detected and recorded at periodic intervals by the disabling device and that calculates a rate of change, either increase or decrease, in temperature over an interval of time comprising at least some of the period intervals at which temperature measurements were detected and recorded. The computing device is communicatively connected to the disabling device to receive information detected by the disabling device and transmitted to the computing device.

In another aspect, the invention can feature the furniture apparatus being a furniture item selected from among the following group: a media console or media cabinet, a television stand, a cabinet, a dresser, a bureau, a chest of drawers, a nightstand, a wardrobe cabinet, a bookcase, a desk, a credenza, a buffet cabinet, a china cabinet, a pantry cabinet, a chest, a trunk, a headboard of a bed, a footboard of a bed, and any other suitable furniture item comprising sufficient space within which the furniture compartment may be formed for containing the fireplace insert.

A method of the invention can be used for concealing an electric fireplace. The method can include the steps of: (a) installing an electric fireplace insert inside an opening of a furniture apparatus, wherein the furniture apparatus includes a fireplace compartment formed within to receive the installed electric fireplace insert and a concealing panel that is removably installed proximal to the opening and is alternately configurable between a concealed configuration and an open configuration; (b) configuring the concealing panel in the open configuration when a view is desired of simulated flames that are visible through the opening at a front surface of the electric fireplace insert; and (c) configuring the concealing panel in the concealed configuration to at least partially cover the opening when concealment of the electric fireplace insert is desired.

Another method of the invention can include steps (b) and (c) of the method further including a step selected from among the following group: (d) concealing the opening by closing the concealing panel, wherein the concealing panel includes at least one door attached to the furniture apparatus by one or more hinges and is shaped and sized to be capable of closing to cover the opening so as to conceal the fireplace insert; (e) concealing the opening by closing the concealing panel, wherein the concealing panel includes at least one sliding door movable within at least one track installed on the furniture apparatus and is shaped and sized to be capable of closing to cover the opening so as to conceal the fireplace insert; and (f) concealing the opening by closing the concealing panel, wherein the concealing panel includes a removable panel that is shaped and sized to be capable of being removably placed over the opening so as to conceal the fireplace insert.

Another method of the invention can include the step of (g) turning off power to a heating apparatus installed inside the electric fireplace insert when the concealing panel is configured in the concealed configuration and an increase in temperature is detected by a disabling device that controls power supplied to the heating apparatus.

A method of the invention can also be used for controlling power to a heating apparatus of an electric fireplace insert. The method can include the steps of: (a) providing a structure in which an electric fireplace insert is installed, wherein the electric fireplace insert includes a heating apparatus for generating heat and a disabling device for detecting changes in temperature; (b) measuring a temperature at a location inside the structure at periodic intervals of time using the disabling device; (c) storing the measured temperatures in a computing device; (d) calculating a rate of change in temperature using the computing device based on the measured temperatures stored in the computing device; and (e) turning off power to the heating apparatus when a temperature increase above a first threshold is detected in the structure.

Another method of the invention can include the step of (g) turning on power to the heating apparatus when a temperature decrease below a second threshold is detected in the structure.

Another method of the invention can include step (e) of the method preventing overheating and power usage when a concealing panel of the structure is configured in a concealed configuration so as to conceal the electric fireplace insert when the electric fireplace insert is not in use.

A method of the invention can also be used for controlling power to a heating apparatus of an electric fireplace insert. The method can include the steps of: (a) providing a structure in which an electric fireplace insert is installed, wherein the electric fireplace insert includes a heating apparatus for generating heat and a disabling device for detecting changes in temperature; (b) measuring a temperature at a location inside the structure at periodic intervals of time using the disabling device; and (c) turning off power to the heating apparatus when a temperature at or above a first threshold is detected in the structure.

Another method of the invention can include the step of (g) turning on power to the heating apparatus when a temperature at or below a second threshold is detected in the structure.

Another method of the invention can include the step (c) of the method preventing overheating and power usage when a concealing panel of the structure is configured in a concealed configuration so as to conceal the electric fireplace insert when the electric fireplace insert is not in use.

A method of the invention can also be used for controlling power to a heating apparatus of an electric fireplace insert. The method can include the steps of: (a) installing an electric fireplace insert inside an opening of a furniture apparatus, wherein the furniture apparatus includes a fireplace compartment formed within to receive the installed electric fireplace insert and a concealing panel that is removably installed proximal to the opening and is alternately configurable between a concealed configuration and an open configuration; (b) configuring the concealing panel in the open configuration when a view is desired of simulated flames that are visible through the opening at a front surface of the electric fireplace insert, wherein power to a heating apparatus of the electric fireplace insert is turned on by a switch, which is communicatively connected to a disabling device, when the concealing panel is in the open configuration; and (c) configuring the concealing panel in the concealed configuration to at least partially cover the opening when concealment of the electric fireplace insert is desired, wherein power to the heating apparatus is turned off by the switch when the concealing panel is in the concealed configuration.

Another method of the invention can include the switch being installed on the furniture apparatus near to the opening, on the concealing panel, or on both.

Another method of the invention can include the switch including a biased switch, a toggle switch, or a rotary switch.

Another method of the invention can include the switch including a magnetic proximity switch.

Another method of the invention can include the switch including an optical switch.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
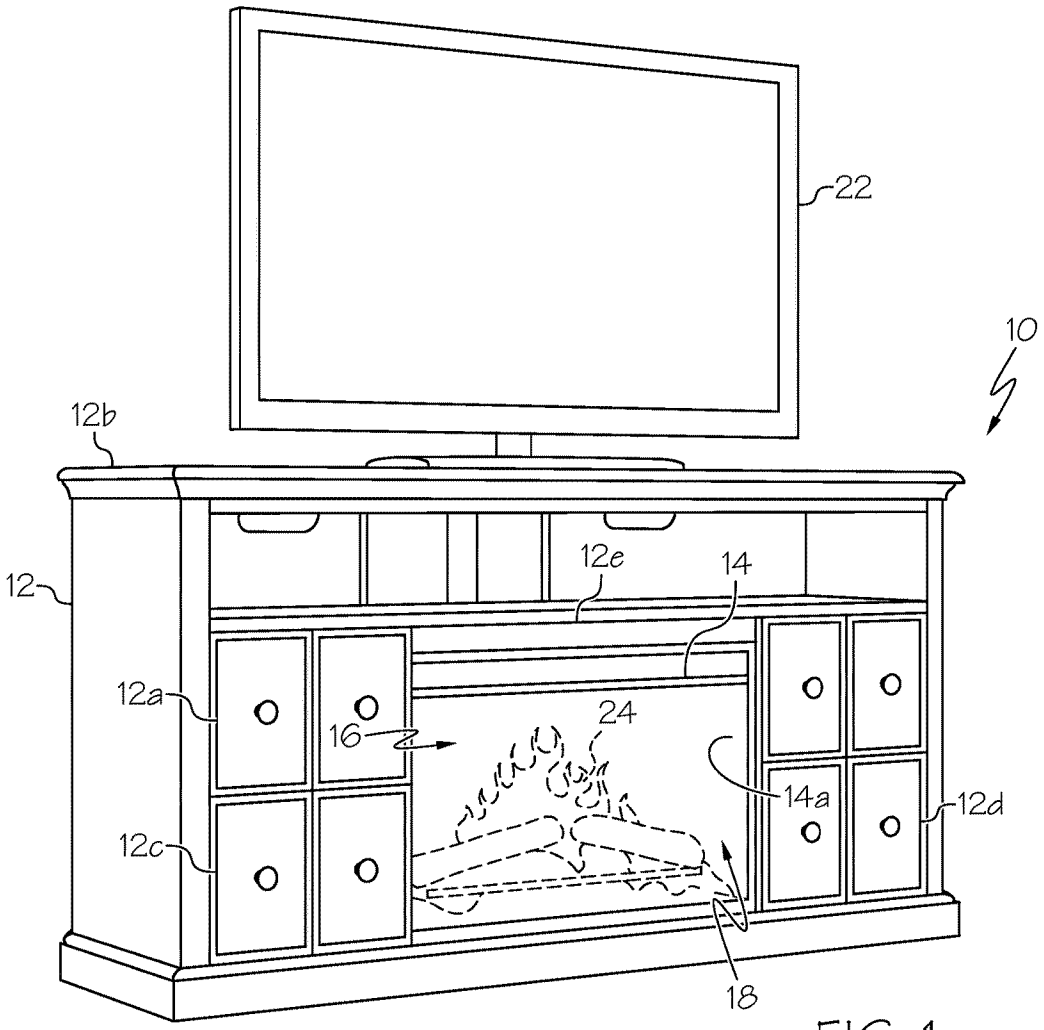
FIG. 1 is a front perspective view of one embodiment of a combined furniture and heating device having a furniture apparatus configured in an open configuration and a fireplace insert installed within a fireplace compartment of the furniture apparatus and being visible through an opening of the fireplace compartment.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The invention relates to a combined furniture and heating device 10 that includes a furniture apparatus 12 and a fireplace insert 14. As shown in FIGS. 1-5, the device 10 provides an electric fireplace having a concealable fireplace insert 14 installed within a furniture apparatus 12 that is alterable between an open configuration and a concealed configuration. The furniture apparatus 12 includes a fireplace compartment 16 formed within the furniture apparatus and an opening 18 on at least one side of the furniture apparatus through which a front surface 14*a* of the fireplace insert 14 is viewable. Although the fireplace insert 14 can be a gas fireplace or wood-burning fireplace with sufficient additional equipment including safety features, in exemplary embodiments (including those described hereinafter), the fireplace insert is an electric fireplace insert 14. The furniture apparatus 12 also includes a concealing panel 20 for altering the configuration of the furniture apparatus between the open configuration and the concealed configuration and vice versa.

The furniture apparatus 12 may include a front facing surface 12*a* with other additional openings in which objects may be placed. The other additional openings may be recessed shelves or drawers of the furniture apparatus. The concealing panel 20 may be sized and shaped so as to cover and conceal the opening 18 into the fireplace compartment 16. In other embodiments, the concealing panel may be sized and shaped so as to cover and conceal the other additional openings in the front facing surface of the furniture apparatus. The furniture apparatus 12 may additionally include side surfaces and a rear surface, one or more of which may be finished to increase the aesthetic appeal of the furniture. Furthermore, the furniture apparatus can include a substantially flat top surface 12*b*, which may receive an object 22 placed thereon such as a television.

Figure 2:
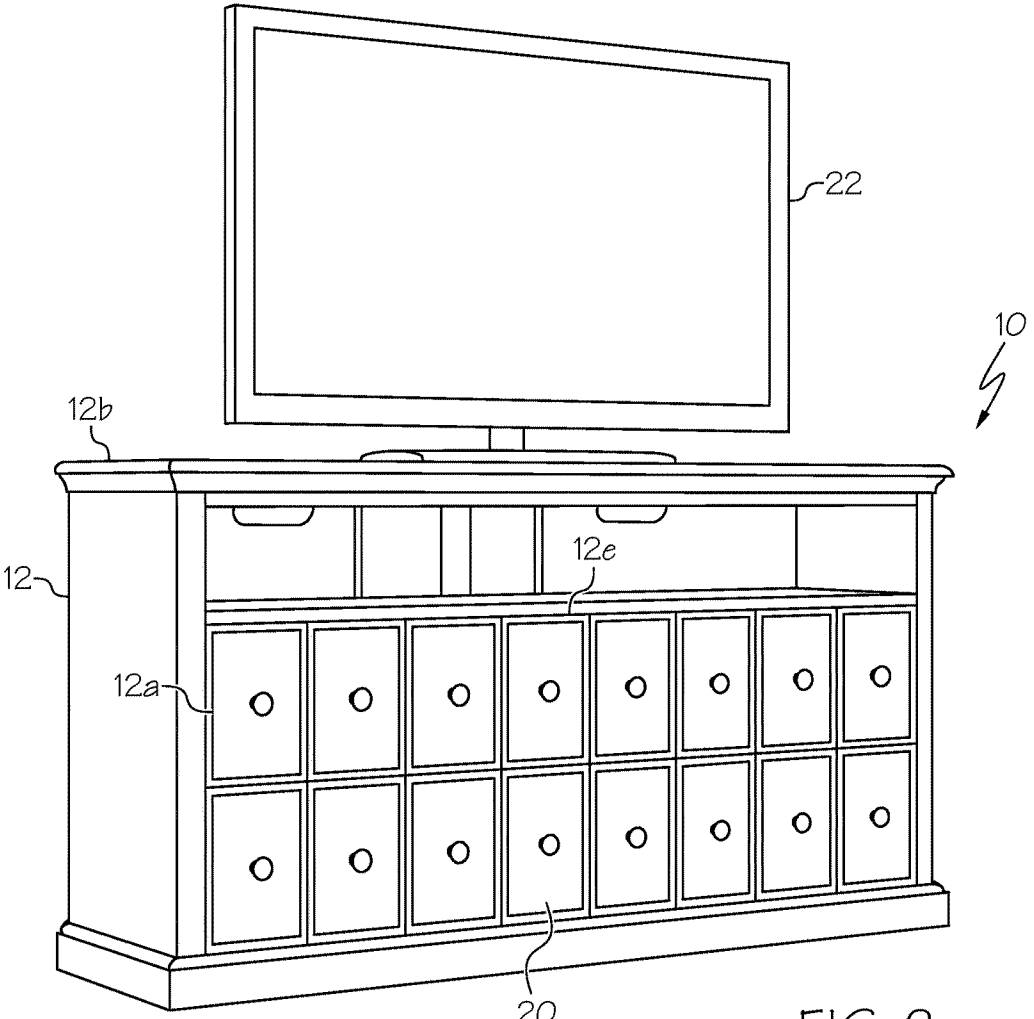
FIG. 2 is a front perspective view of the furniture apparatus of FIG. 1 configured in a concealed configuration in which a concealing panel is installed over the opening of the fireplace compartment to cover and conceal the fireplace compartment and the fireplace insert installed therein.
Figure 3:
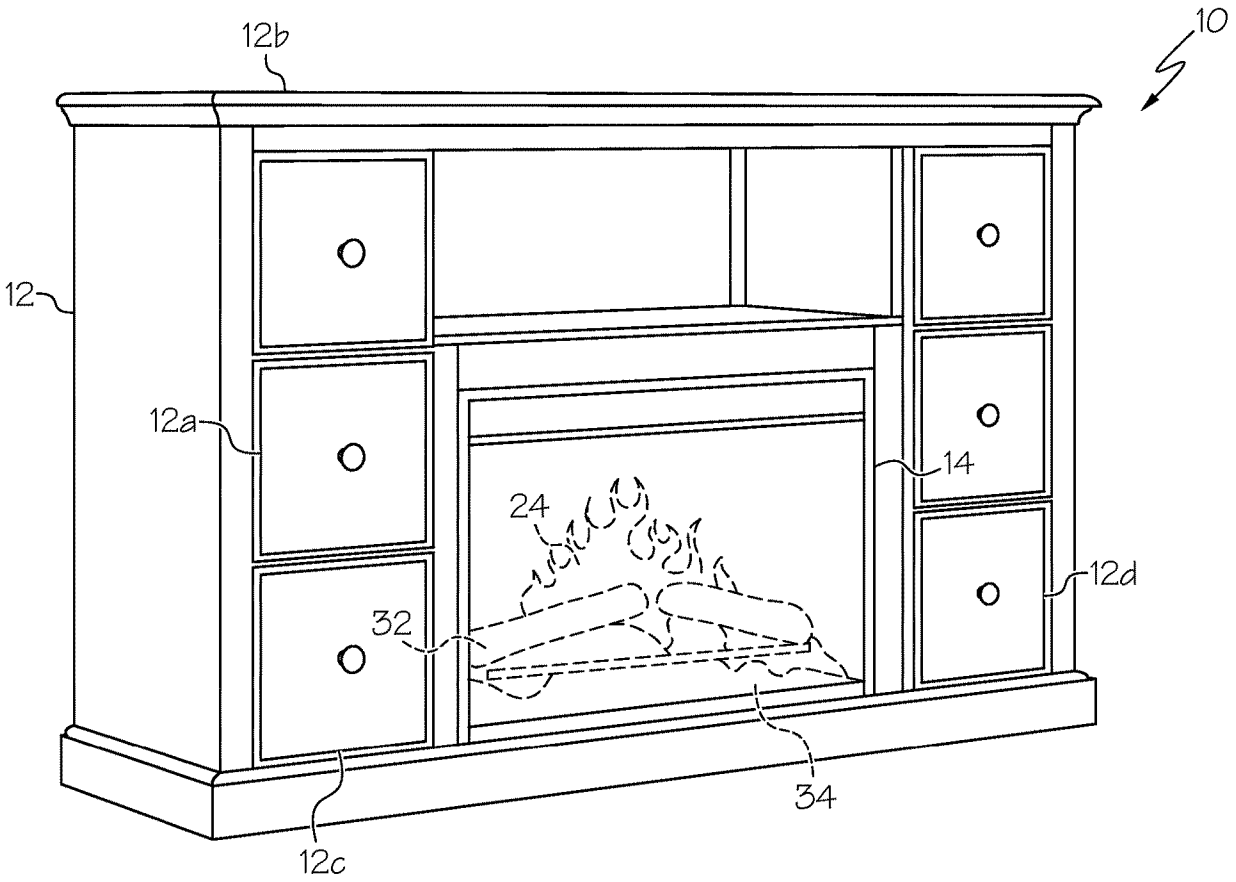
FIG. 3 is a front perspective view of another embodiment of a combined furniture and heating device having a furniture apparatus configured in an open configuration and a fireplace insert installed within a fireplace compartment of the furniture apparatus and being visible through an opening of the fireplace compartment.
Figure 4:
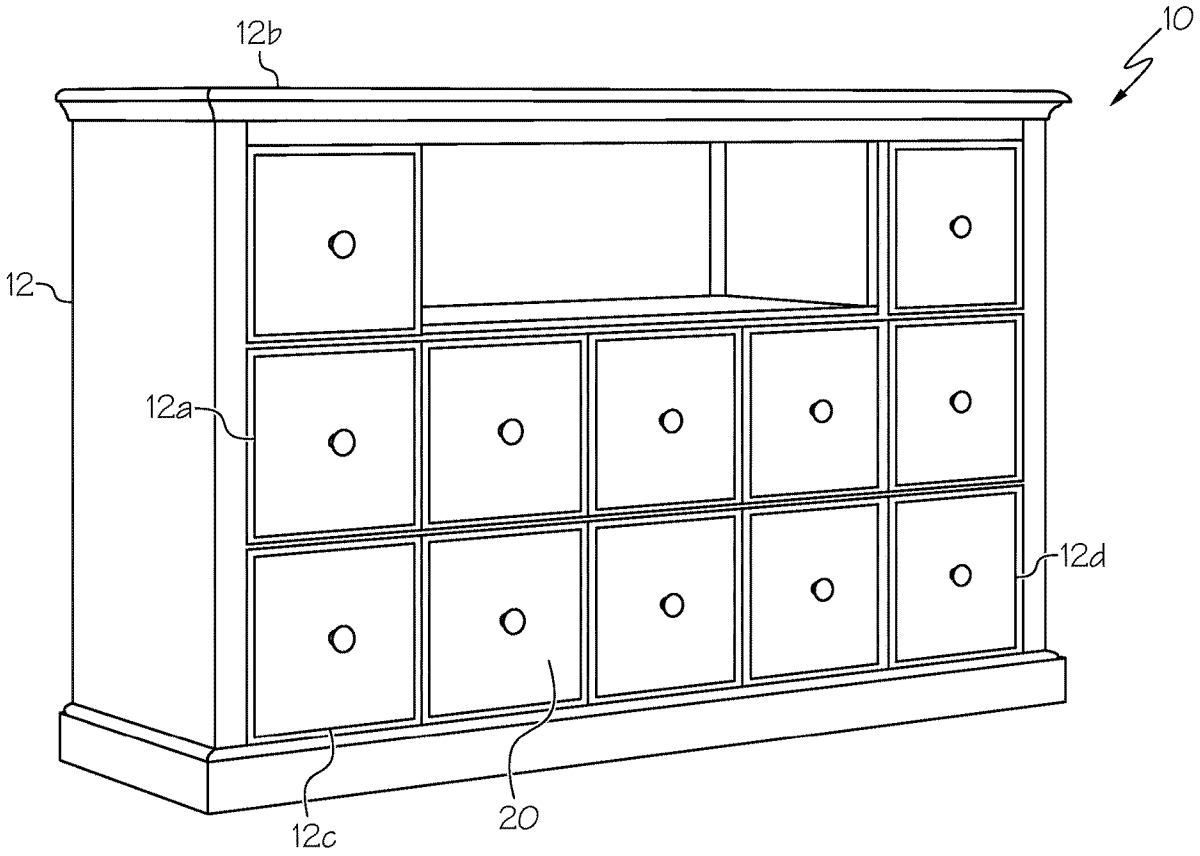
FIG. 4 is a front perspective view of the furniture apparatus of FIG. 3 configured in a concealed configuration in which a concealing panel is installed over the opening of the fireplace compartment to cover and conceal the fireplace compartment and the fireplace insert installed therein.
Figure 5:
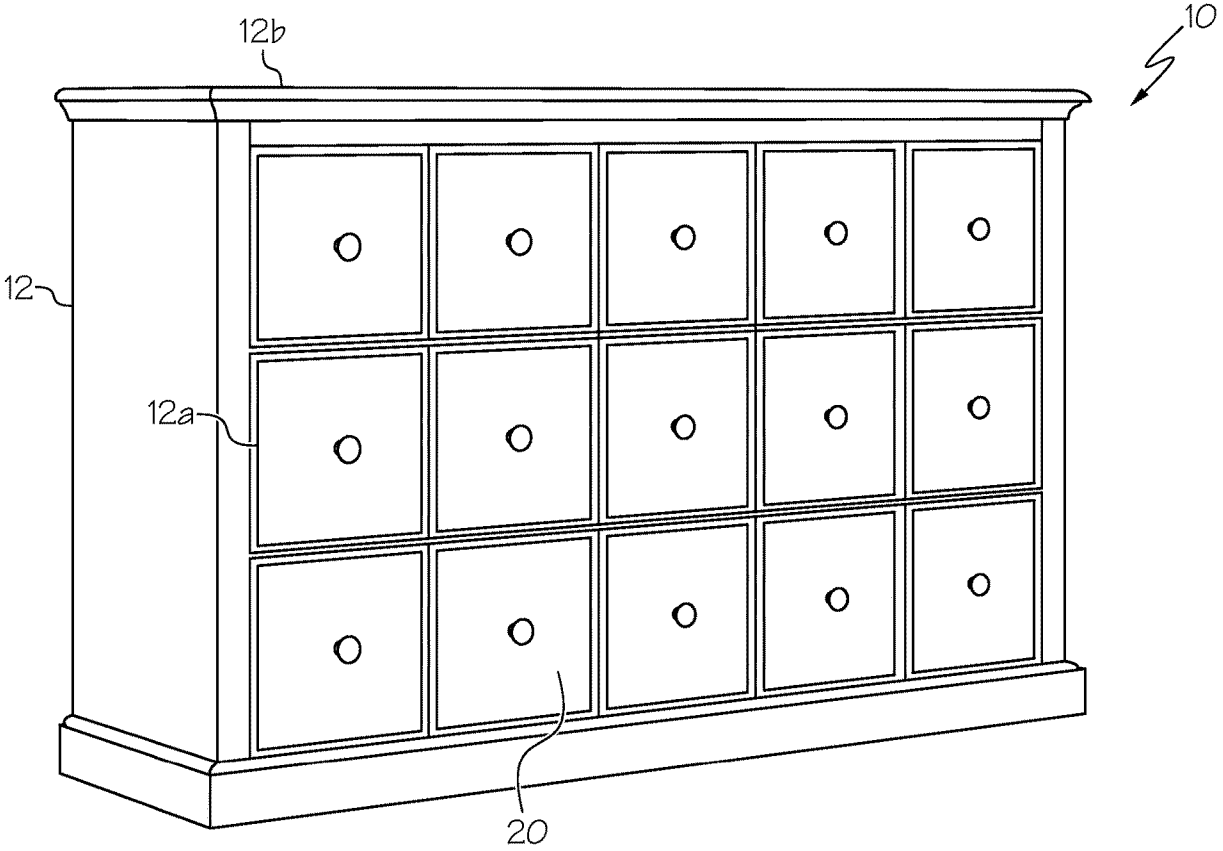
FIG. 5 is a front perspective view of another embodiment of a combined furniture and heating device having a furniture apparatus configured in a concealed configuration.

As seen in the example illustrated in FIGS. 1-2, the furniture apparatus may include an elongated slot near a top central portion of the furniture apparatus. The furniture apparatus 12 may additionally include right and left side shelves and/or drawers 12*c*, 12*d* concealable by doors. Skilled artisans will appreciate additional configurations of the furniture apparatus that may include additional slots, shelves, drawers, and other features, which may be located in virtually any location on the furniture apparatus.

The fireplace compartment 16 of the furniture apparatus 12 may have approximately similar dimensions as the fireplace insert 14 to be inserted into the fireplace compartment. The fireplace insert 14 may be installed inside the fireplace compartment 16 through a bottom opening of a bottom surface of the furniture apparatus, through a rear opening of a rear surface of the furniture apparatus, or through a left or right side opening of the furniture apparatus. In such embodiments, the opening through which the fireplace insert is installed may be covered by a panel of the furniture apparatus that is substantially permanently installed during manufacturing. In another embodiment, the fireplace insert 14 may be installed inside the furniture apparatus 12 by insertion through the opening 18 into the fireplace compartment 16 at the furniture apparatus's front facing surface 12*a*. As illustrated in FIG. 1, the fireplace compartment 16 may be located in a bottom central location of the furniture apparatus 12. Typically, an electric fireplace insert 14 may be installed within the fireplace compartment 16.

Examples of the furniture apparatus 12 in which the fireplace insert can be installed and concealable include an entertainment stand (such as a television stand or electronics stand), a dresser, a console, a chest, a desk, a credenza, a table, a bench, a cabinet, a bookcase, a hutch, a wardrobe cabinet, an armoire, a vanity, a media console or media cabinet, a bureau, a chest of drawers, a nightstand, a buffet cabinet, a china cabinet, a pantry cabinet, a trunk, a headboard of a bed, a footboard of a bed, or any other suitable furniture item having sufficient space within which the furniture compartment may be formed for containing the fireplace insert. In another embodiment, the fireplace insert 14 may be installed within a furniture apparatus 12 that is a wall unit and/or built-in furniture apparatus such as, for example, a built-in desk, workspace, or entertainment center. In still another embodiment, the built-in furniture apparatus 12 in which the fireplace insert 14 can be installed also can be a Murphy bed (also called a wall bed or pull-down bed).

The furniture apparatus 12 may be constructed using virtually any material. For example, the furniture apparatus may be constructed using wood, metal, composites, glass, stone, plastics, and other suitable materials. In preferred embodiments, the fireplace insert 14 can be electric. In other embodiments, the fireplace insert may heat using gas. Simulated flames 24 (in the case of the preferred electric fireplace, or real flames in the case of a gas-heating insert) may be viewable via the front surface 14*a* of the fireplace insert 14 when the concealing panel 20 is manipulated so that the furniture apparatus 12 is configured in the open configuration. The open configuration allows the simulated flames 24 of the electric fireplace insert 14 (or real flames in the case of gas-powered inserts) to be visible and for the fireplace insert to radiate or blow heated air through the opening into a room in which the device 10 is located. In the interest of clarity, the following examples will be discussed in the context of an electric fireplace installed within wooden furniture, without limitation.

The fireplace insert 14 may be installed within the fireplace compartment 16 to a depth that accommodates concealment of the fireplace insert when a concealing panel 20, such as a door or cover that can be installed in front of the opening of the fireplace compartment, is installed. For example, the fireplace insert 14 may be installed within the furniture apparatus 12 to a depth that, when the concealing panel 20 is installed, the concealing panel is substantially flush with the additional doors, drawer fronts, or covers of the furniture, as illustrated in FIG. 2. The concealing panel 20 can be one object (e.g., one hinged door, one sliding door, or one removable panel), two objects, or more.

In one embodiment, the concealing panel 20 can include at least one door attached to the furniture apparatus 12 by one or more hinges and capable of being opened to uncover the opening 18 so as to reveal the fireplace insert 14 when the furniture apparatus is configured in the open configuration and capable of closing to cover the opening so as to conceal the fireplace insert when the furniture apparatus is configured in the concealed configuration.

In another embodiment, the concealing panel 20 can include at least one sliding door movable within at least one track installed on the furniture apparatus 12 and capable of closing to cover the opening 18 so as to conceal the fireplace insert 14 when the furniture apparatus is configured in the concealed configuration. The at least one sliding door can be opened to uncover the opening so as to reveal the fireplace insert when the furniture apparatus is configured in the open configuration.

In yet another embodiment, the concealing panel 20 can include at least one removable panel that is capable of being placed over the opening 18 so as to conceal the fireplace insert 14 when the furniture apparatus 12 is configured in the concealed configuration. The at least one removable panel can be removed from the opening of the furniture apparatus to reveal the fireplace insert inside the fireplace compartment when the furniture apparatus is configured in the open configuration The concealing panel 20 can be constructed from materials and in colors that are the same as, similar to, or that match the materials and colors of the furniture apparatus.

Removal and installation of the concealing panel 20 or panels alters the configuration of the furniture apparatus 12 between the open configuration, in which the fireplace insert 14 is visible inside the fireplace compartment 16 through the opening 18, and the closed concealed configuration, in which the opening 18 is covered by the concealing panel 20 or panels so that the fireplace compartment 16 and fireplace insert 14 therein are hidden or concealed and not visible from outside the furniture apparatus. The at least one concealing panel 20 may be storable within the furniture apparatus 12 when the furniture apparatus is configured in the open configuration. For example, in one embodiment, the door or doors can be sliding doors that are pocket doors.

In embodiments in which the at least one concealing panel 20 includes one or more pocket doors, the furniture apparatus 12 can include one or more slots formed in a front wall of the furniture apparatus to the left and right of the opening 18 at the fireplace compartment 16. For example, if the concealing panel includes one pocket door, the furniture apparatus may include only a single slot either on the left or on the right of the opening. In other embodiments in which the concealing panel includes double pocket doors (or even in embodiments that include only a single pocket door), the furniture apparatus can include slots on both the left and ride sides of the opening. The pocket door or doors may be at least partially slidable into the slots for partial or total concealment while the furniture apparatus is configured in the open configuration so that the electric fireplace insert is viewable. If the configuration of the furniture apparatus's concealing panel is altered to the concealed configuration, the pocket door or doors may be removed from their respective slots or slots and closed over the opening in front of the fireplace insert to conceal it from view within the fireplace compartment.

In an additional embodiment, the concealing panel 20 can be a door that is substantially attached at a top edge 12*e* of the opening 18 of the furniture apparatus 12 above the fireplace compartment 16. In this embodiment, altering the configuration of the furniture apparatus can be altered from the concealed configuration to the open configuration by lifting the door upwardly to expose the fireplace insert within the fireplace compartment. Optionally, the furniture apparatus can include a slot located above the fireplace compartment into which the door can be slid and concealed. Skilled artisans will appreciate additional configurations of doors, covers, or other concealing objects to alter the furniture apparatus between the concealed configuration and the open configuration.

Alternatively, the at least one concealing panel 20 can be one or more covers or removable panels that are removable from the furniture apparatus 12 and that can be stored elsewhere when the heating apparatus of the fireplace insert is being operated when the furniture apparatus is configured in the open configuration. In yet another embodiment, the at least one concealing panel can be one or more hinged doors remain attached to the furniture apparatus when it is configured in the open configuration to reveal the fireplace insert inside the fireplace compartment. For example, in some embodiments, the doors may be a hinged single door or hinged double doors.

The fireplace insert 14 may be an electric fireplace with a front surface 14*a* through which simulated flames 24 are viewable. The fireplace insert 14 may additionally include top, bottom, side, and rear surfaces to facilitate installation of the fireplace insert within the furniture apparatus 12. The fireplace insert 14 can include a heating apparatus 26, a fan or blower 28 to disperse or circulate air, or both. The fireplace insert 14 can also include lighting devices 30 to create simulated flames 24 visible to a viewer through the front surface 14*a* of the fireplace insert when the furniture apparatus 12 is configured in the open configuration. The fireplace insert 14 can also include a simulated fuel source 32 (e.g., artificial logs), a simulated ember bed 34, or both. The fireplace insert 14 may also include a speaker or speakers and a player device for playing sounds such as, for example, a sound of crackling embers, music, or other sound recordings, radio stations, cable or satellite music channels, or streaming audio over a network such as the Internet. Such speaker or speakers and player device can be installed in the furniture apparatus 12 in alternate embodiments. In one embodiment, the fireplace insert may be removably installed within the furniture apparatus. In an additional embodiment, the fireplace insert may be substantially permanently installed in the furniture.

The fireplace insert 14 is installed within the fireplace compartment 16 of the furniture apparatus 12. The fireplace insert 14 includes a front surface 14*a* at which flames are viewable when the concealing panel 20 is placed in the open configuration. The concealing panel 20 can be removably installed proximal to the front surface 14*a* of the fireplace insert 14 and is alternately configurable in the concealed configuration to at least partially conceal the fireplace insert and the open configuration to reveal the front surface of the fireplace insert.

The combined furniture and concealable heating device 10 can include a disabling device 36 to turn on and turn off power to the heating apparatus 26 that is located inside the fireplace insert. The disabling device 36 is used to turn off power to or otherwise disable the heating apparatus 26 upon certain conditions being met. Examples of conditions that can be used to turn off or disable the heating apparatus (and to turn on or enable it) are the configuration of the furniture apparatus in the open or concealed configuration, temperature, rate of change of temperature, light, and the state of various types of contact switches. The disabling device 36 can turn off power to the heating apparatus 26 after the concealing panel 20 is configured in the concealed configuration and can turn on power to the heating apparatus after the concealing panel is configured in the open configuration.

In one embodiment, the disabling device 36 can turn off power to the heating apparatus 26 when a temperature increase above a first threshold is detected in the combined furniture and heating device and can turn on power to the heating apparatus when a temperature decrease below a second threshold is detected in the combined furniture and heating device 10. The disabling device 36 can include at least one thermistor 36 for detecting the temperature increase above the first threshold and the temperature decrease below the second threshold. In exemplary embodiments, the thermistor 36 can be a negative temperature coefficient (NTC) thermistor. The NTC thermistor may measure temperature in degrees Fahrenheit, degrees Celsius, or Kelvin (K).

Figure 6:
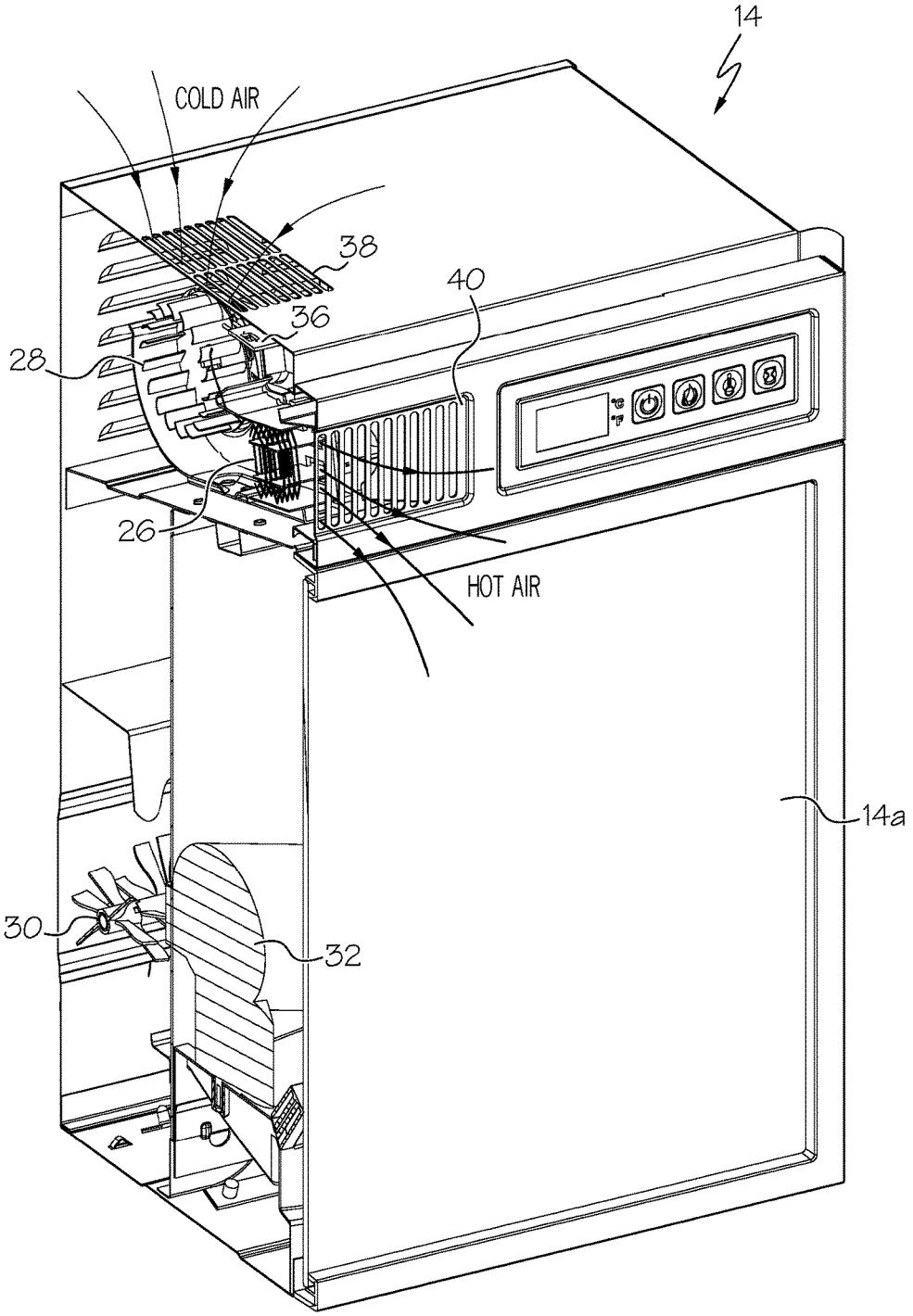
FIG. 6 is a front perspective partial cut-away view of an electric fireplace insert of one embodiment of a combined furniture and heating device without a concealing panel installed over a front of the electric fireplace insert.
Figure 7:
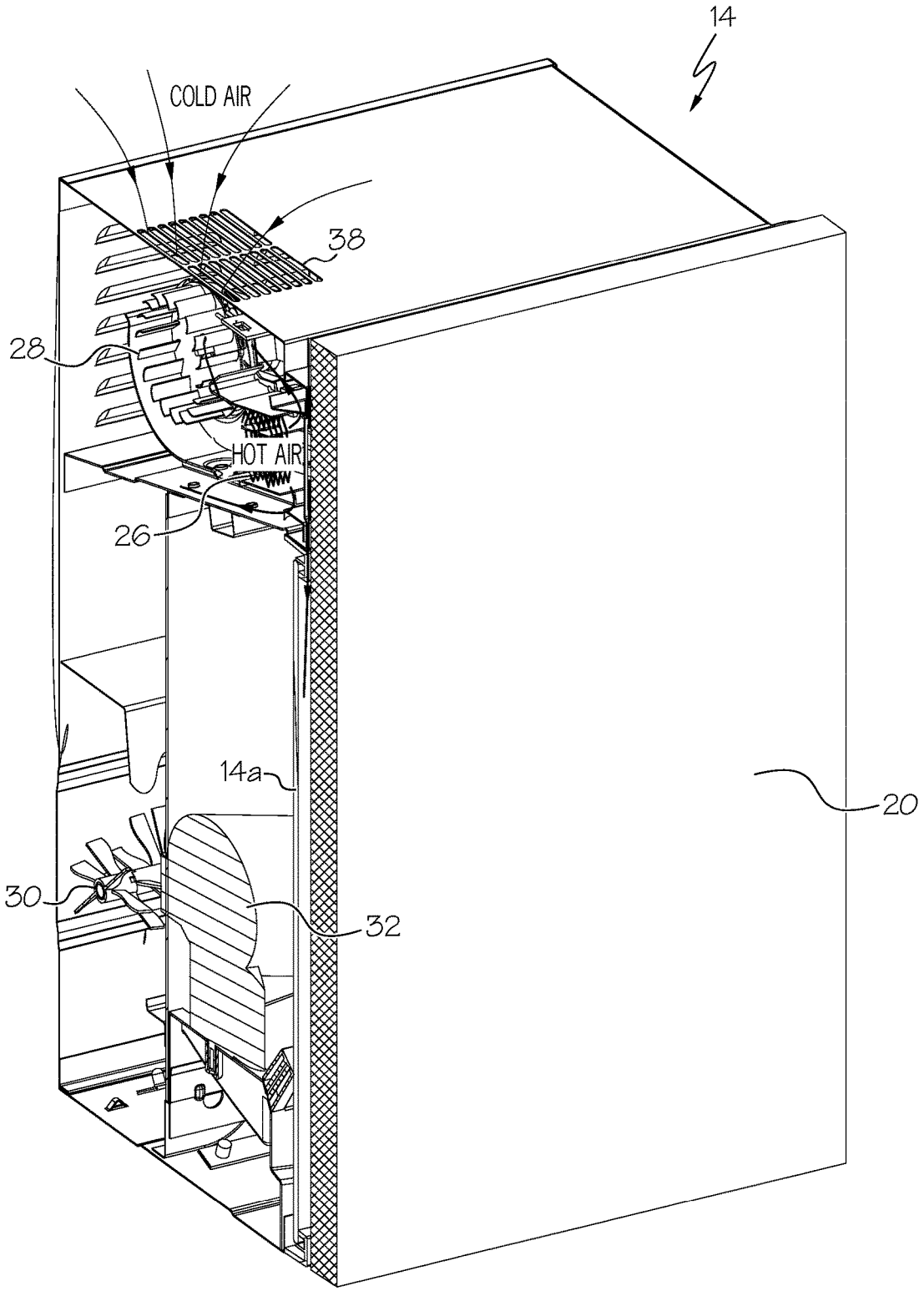
FIG. 7 is a front perspective partial cut-away view of the electric fireplace insert of FIG. 6 with a concealing panel installed over a front of the electric fireplace insert.

In exemplary embodiments, as shown in FIGS. 6 and 7, the disabling device (or its thermistor) 36 can be installed inside the fireplace insert 14 close to a cold air intake vent 38 that receives ambient air at ambient room temperature. If the concealing panel 20 is removed or open so that the furniture apparatus 12 is configured in the open configuration, the temperature inside the fireplace insert 14 around the thermistor 36 will remain lower than the first threshold because the air heated by the heating apparatus 26 will be blown out of the fireplace insert by the blower or fan 28. The heating apparatus 26 can continue to receive power and operate to produce heated air. However, if the concealing panel 20 is closed or installed in place over the opening 18 of the fireplace compartment 16 so that the furniture apparatus 12 is configured in the concealed configuration, the temperature inside the fireplace insert 14 around the thermistor 36 will rise because the concealing panel 20 blocks the exit of heated air from the fireplace insert through a heated air vent 40. As the heating apparatus 26 continues to heat air and as the opening 18 remains covered by the concealing panel 20, eventually the temperature inside the fireplace insert 14 around the thermistor 36 may exceed the first threshold. After the temperature of air around the thermistor 36 exceeds the first threshold, depending on whether the disabling device 36 is programmed to turn off power at a specific temperature or in response to a certain rate of temperature increase, the disabling device can turn power to the heating apparatus 26 so that heating ceases. The disabling device 36 serves both to conserve electricity by disabling power to the heating apparatus 26 when the concealing panel 20 placed in the concealed configuration renders the fireplace insert 14 blocked inside the fireplace compartment 16 so that its heated air cannot be adequately blown into the room through the heated air vent 40, and also to ensure that the fireplace insert does not overheat resulting in malfunction or fire.

The first threshold can be a specific or approximate first temperature level and the second threshold being a specific or approximate second temperature level. For example, the first threshold can be a temperature of 140 degrees Fahrenheit (as an example; other temperatures may also be used for the various temperature thresholds described herein) so that when the temperature is detected by the disabling device to meet or exceed that temperature, power to the heating apparatus is turned off or disabled. Likewise, the disabling device can turn on power or enable the heating apparatus when the detected temperature falls below 140 degrees Fahrenheit.

Figure 8:
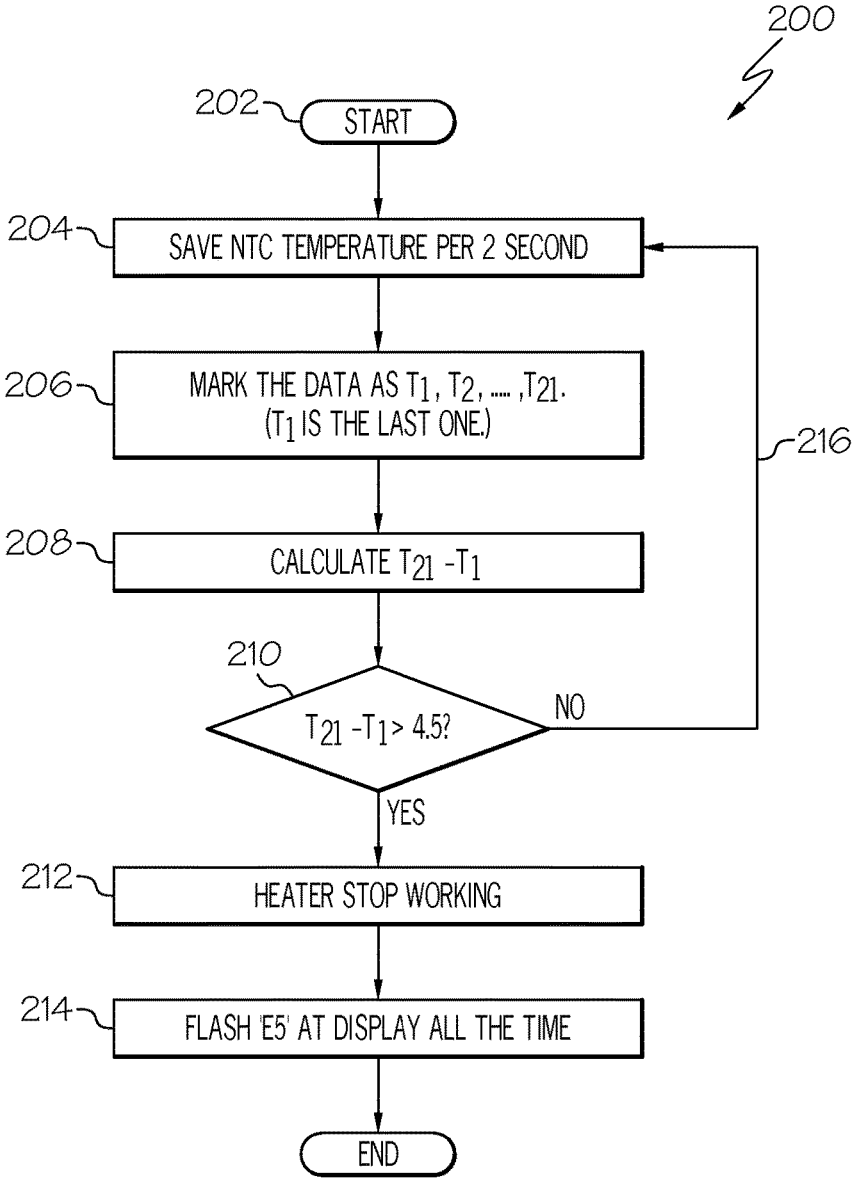
FIG. 8 is a flowchart diagram showing the processes of a method for disabling a heating apparatus of a combined furniture and heating device.

In an other embodiment, a shown in FIG. 8, the first threshold can be a rate of temperature increase determined over a first interval of time and the second threshold being a rate of temperature decrease determined over a second interval of time. The NTC thermistor of the disabling device can be programmed to take temperature measurements at approximately two second intervals. The measurement data from each temperature measurement can be saved by a computing device 42 as T1, T2, T3, etc. The computing device 42 can be a part of the disabling device 36 or the computing device can be a separate component of the fireplace insert 14 or of furniture apparatus 12 of the combined furniture and heating device 10 and communicatively connected to the disabling device 36.

The computing device 42 can store data related to temperature measurements detected and recorded at periodic intervals by the disabling device 36 and can calculate a rate of change, either increase or decrease, in temperature over an interval of time that includes at least some of the period intervals at which temperature measurements were detected and recorded. The computing device 42 can be communicatively connected to the disabling device 36 to receive information detected by the disabling device and transmitted to the computing device either by a wired connection or by wireless communication.

In one example, the NTC thermistor 36 can take 21 temperature measurements at approximately 2-second intervals of time. The computing device 42 can perform a calculation by subtracting the temperature of the first measurement T1 from the temperature of the last measurement T21. If T21 minus T1 is greater than 4.5 K (i.e., a temperature increase of 4.5 K), then the disabling device 36 can turn off power to the heating apparatus 26 so that the heating apparatus discontinues actively producing heat. If the computing device 42 calculates that T21 minus T1 is less than 4.5 K, then the power to the heating apparatus 26 is not disabled and the temperature measurement cycle begins again for (in this example) another 21 temperature measurements at approximately 2-second intervals of time. The temperature measurement cycle is repeated continuously until a temperature increase exceeding the programmed threshold is reached at which time the heating apparatus is disabled by the disabling device. The disabling device can also be capable of turning off power to and disabling other features of the fireplace insert including, for example, the light system, the fan or blower, and other components.

Figure 9:
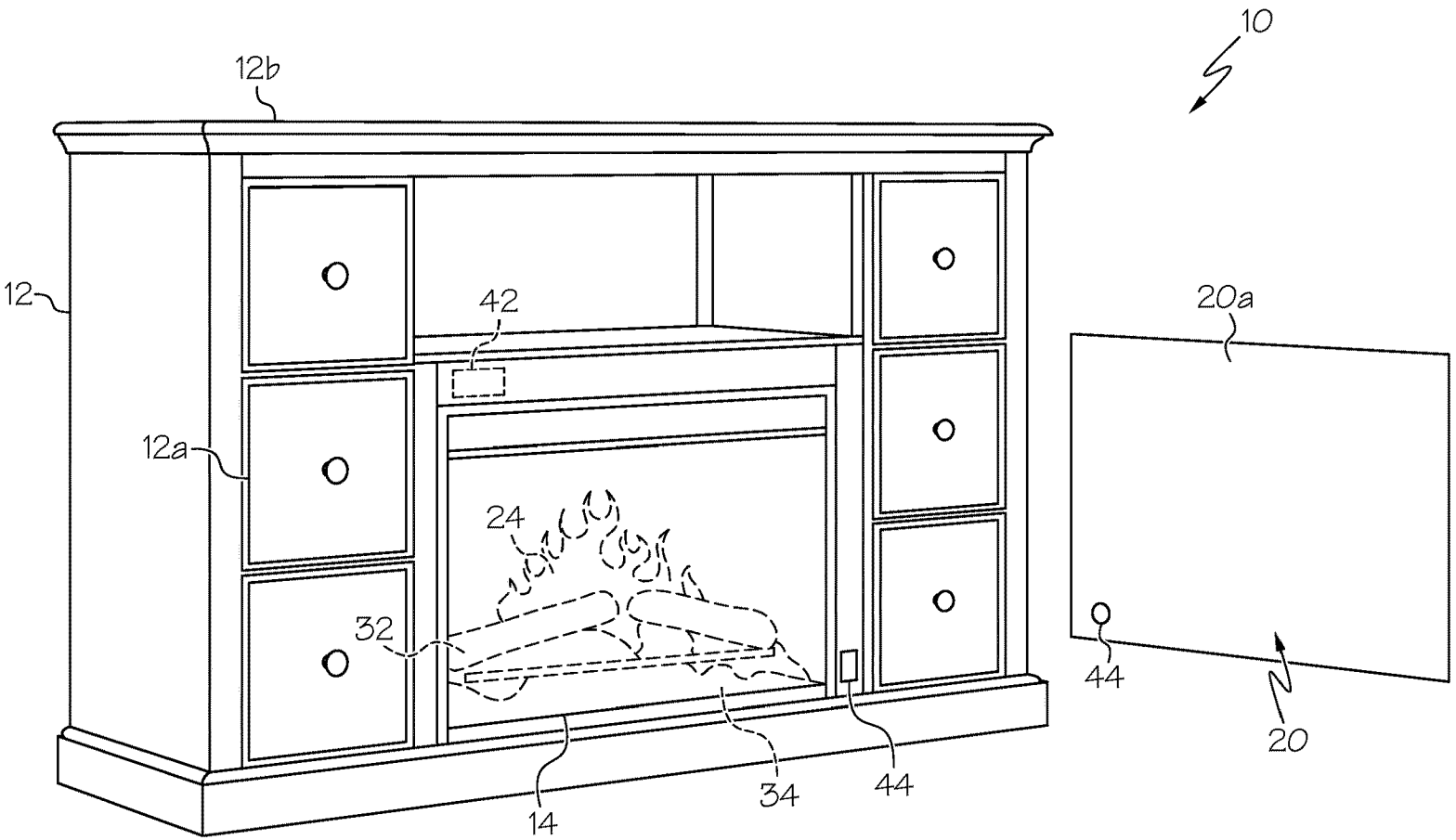
FIG. 9 is a front perspective view of the furniture apparatus of FIG. 3 showing a switch installed on the furniture apparatus with the concealing panel removed from the opening of the fireplace compartment while the furniture apparatus is configured in the open configuration.
Figure 10:
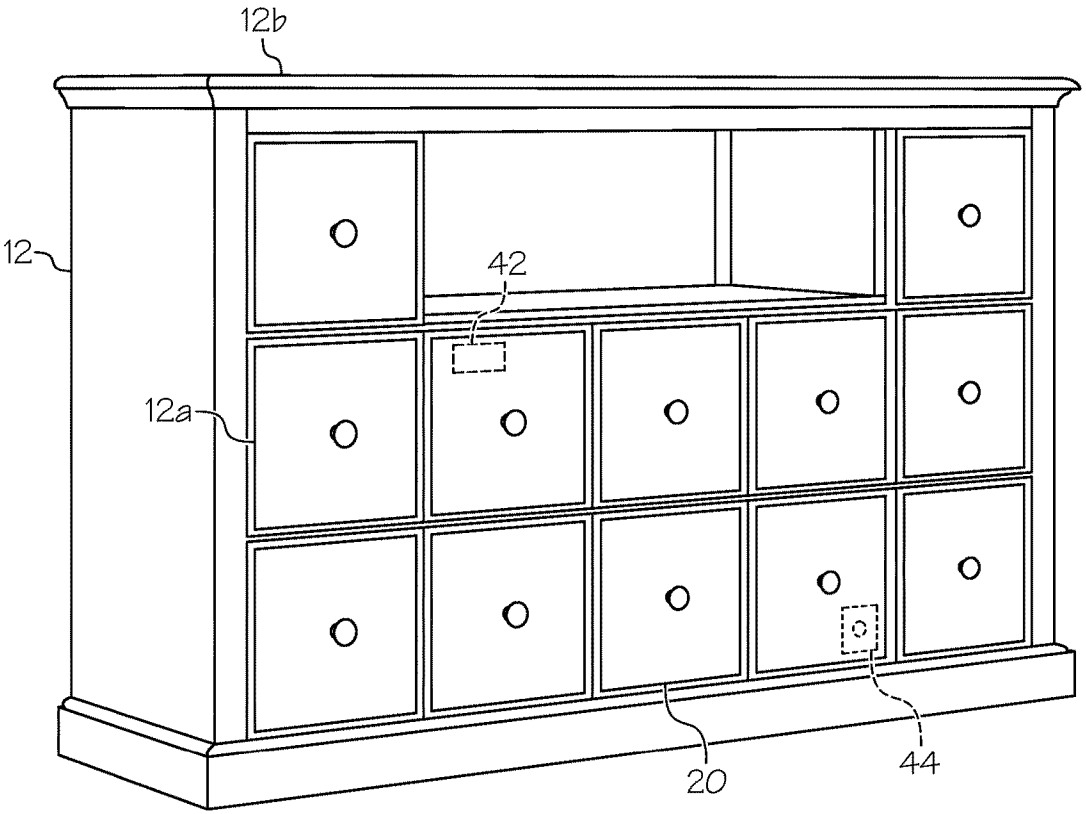
FIG. 10 is a front perspective view of the furniture apparatus of FIG. 9 showing the switch in phantom view installed on the furniture apparatus with the concealing panel covering the opening of the fireplace compartment while the furniture apparatus is configured in the concealed configuration.

In other embodiments, the disabling device 36 can include a switch 44. As shown in FIGS. 9 and 10, the switch 44 can be a contact switch, a magnetic proximity switch, or an optical switch. The switch 44 can be installed on the furniture apparatus 12 next to the opening 18. The switch 44 can include components that are also installed on a rear side 20*a* of the concealing panel 20. The switch 44 can be used by the disabling device 36 to turn on and turn off power to the heating apparatus 26 as the concealing panel 20 is configured between the open configuration and the closed configuration. In one embodiment, power to the heating apparatus 26 can be turned off when two parts of a contact switch 44 come into contact with one another when the concealing panel 20 is closed or installed so that the concealing panel is configured in the concealed configuration. Power can be turned on again by the disabling device 36 when the two parts of the switch 44 are no longer in contact with one another once the concealing panel 20 is removed or opened when the concealing panel is configured in the open configuration.

In another embodiment that includes a magnetic proximity switch, power to the heating apparatus can be turned off when two parts of a magnetic contact switch come into close proximity to one another when the concealing panel is closed or installed so that the concealing panel is configured in the concealed configuration. Power can be turned on again to the heating apparatus by the disabling device when the two parts of the magnetic proximity switch are no longer in close proximity to one another once the concealing panel is removed or opened when the concealing panel is configured in the open configuration.

In yet another embodiment that includes an optical switch, similar to the type used to trigger door bells and alarms in retail stores and other businesses, a light beam can be emitted by a light emitting device installed near the opening toward a reflector installed on the rear side of the concealing panel. When the light beam is reflected back to a sensor of the switch, power is turned off or disabled to the heating apparatus because the disabling device will determine that the concealing panel is covering the opening and the fireplace insert within the fireplace compartment in response to the light beam being reflected back from the reflector on the concealing panel's rear side to the sensor. Power can be turned on again to the heating apparatus when the concealing panel is removed or opened so that the furniture apparatus is configured in the open configuration and the light beam is no longer reflected by the reflector back to the sensor because the sensor and reflector are no longer aligned as they are when the concealing panel is configured in the concealed configuration. The emitted light beam can be infrared in one exemplary embodiment. In another embodiment, the light switch can include a light emitting device that is aligned with a light-detecting sensor so that when the light is not detected, as in the case where the concealing panel is removed or opened when the furniture apparatus is configured in the open configuration, the disabling device would enable the heating apparatus by turning on power to it and when the light is detected, as in the case where the concealing panel is installed or closed when the furniture apparatus is configured in the concealed configuration, the disabling device would disable the heating apparatus by turning off power to it The combined furniture and heating device 10 can include these or other cover detection systems that are switches to detect when the at least one concealing panel 20 is placed at least partially over the opening 18 of the fireplace compartment 16 so as to partially or totaled block and conceal the fireplace insert 14 therein. The cover detection system of the disabling device may be electronic. Using the cover detection system of the disabling device, the heating apparatus of the fireplace insert may be at least partially disabled upon detection of the at least one concealing panel being at least partially covering the opening. This detection may be performed using sensors, which will be described in more detail below. The degree to which the at least one concealing panel may cover the opening in order to trigger power disabling or power enabling to the heating apparatus may be definable, variable, or otherwise determined.

One or more sensors may be included to detect whether the fireplace is operating while the cover is in an open configuration or at least partially concealed configuration. As an example, the disabling device can include at least one sensor that may be a thermally sensitive heat-measuring sensor capable of detecting a heat measurement over time. This heat-detecting sensor may determine an instant level of heat, the rate at which heat changes, or other thermally affected conditions. The temperature or heat data received from the sensors may be processed by the computing device, the results of which could be used to affect the operation of the disabling device capable of turning off power to the electric fireplace insert upon detection of an unsatisfactory condition. An example of an unsatisfactory condition may include, without limitation, an abnormal rate at which heat increases or a higher than desired temperature.

In addition or as an alternative to thermally active sensors, the disabling device can include additional sensors. For example, the disabling device may include proximity sensors to detect a condition and proximity of an object to the fireplace insert or to a part or component of the furniture apparatus, as described above with respect to the contact switches, magnetic proximity switches, and optical switches. Proximity sensors may include ultrasonic, infrared, and other sensors that would be apparent to persons skilled in the art. These additional sensors may supplement, replace, or otherwise operate with thermally active sensors to detect conditions of the fireplace insert in operation, for example, the heating apparatus being powered while covered by the concealing panel placed in the concealed configuration. In one embodiment, these additional sensors may be located at the front of the fireplace insert. However, skilled artisans will appreciate additional locations for sensors included by the combined furniture and heating device.

The disabling component reduces the likelihood of the fireplace insert operating during undesirable conditions. An example of an undesirable condition may be operation of the heating apparatus of the fireplace insert while the concealing panel is in place over the opening when the furniture apparatus is configured in the concealed configuration. The disabling device can reduce the likelihood of problems caused by overheating, for example, excessive energy consumption, increased wear of other components of the fireplace insert such as the mantle or cover, and other heat related damage or fire. In one embodiment, the disabling device may open a circuit to the heating apparatus of the fireplace insert upon detecting an undesirable condition. In an additional embodiment, the disabling device may alter operation of the heating apparatus via a microcontroller or other controlling device. Once the disabling device determines that the undesirable condition is no longer occurring, power may be turned on again to the heating apparatus so that the heating apparatus and its heating capabilities are again enabled.

The electric fireplace insert also can include sensors, circuits, or electronics that disable the light, simulated flames, heating apparatus, and blower components and functions of the fireplace insert when the at least one concealing panel is configured in the concealed configuration so as to cover and conceal the fireplace insert within the fireplace compartment and to enable the light, simulated flames, heating apparatus, and blower components and functions when the at least one concealing panel is configured in the open configuration so as to reveal and render viewable the front of the fireplace insert and its simulated flames.

The invention also relates to a method that can be used for concealing an electric fireplace. The method can include the step of installing an electric fireplace insert inside an opening of a furniture apparatus. The electric fireplace insert, furniture apparatus, and other components used with this and the other methods described herein can be identical or similar to those described above with respect to the combined furniture and heating device. The furniture apparatus can include a fireplace compartment formed within to receive the installed electric fireplace insert and a concealing panel that is removably installed proximal to the opening and that is alternately configurable between a concealed configuration and an open configuration. The method can also include the step of configuring the concealing panel in the open configuration when a view is desired of simulated flames that are visible through the opening at a front surface of the electric fireplace insert. The method can further include the step of configuring the concealing panel in the concealed configuration to at least partially cover the opening when concealment of the electric fireplace insert is desired.

In one embodiment, the method can also include the step of concealing and covering the opening by closing the concealing panel. The concealing panel can include at least one door attached to the furniture apparatus by one or more hinges and can be shaped and sized to be capable of closing to cover the opening so as to conceal the fireplace insert.

In another embodiment, the method can also include the step of concealing and covering the opening by closing the concealing panel. The concealing panel can include at least one sliding door movable within at least one track installed on the furniture apparatus and can be shaped and sized to be capable of closing to cover the opening so as to conceal the fireplace insert inside the fireplace compartment.

In yet another embodiment, the method can also include the step of concealing the opening by closing the concealing panel, in which the concealing panel can include a removable panel that is shaped and sized to be capable of being removably placed over the opening so as to conceal the fireplace insert.

The method can also include the step of turning off power to a heating apparatus installed inside the electric fireplace insert when the concealing panel is configured in the concealed configuration and an increase in temperature is detected by a disabling device that controls power supplied to the heating apparatus.

The invention also relates to a method 200 that can be used for controlling power to a heating apparatus of an electric fireplace insert. The method can include the step 202 of providing a structure in which an electric fireplace insert is installed. The electric fireplace insert can include a heating apparatus for generating heat and a disabling device for detecting changes in temperature. The method can also include the step 204 of measuring a temperature at a location inside the structure at periodic intervals of time using the disabling device. The method can further include the step 206 of storing the measured temperatures in a computing device. The method can also include the step 208 of calculating a rate of change in temperature using the computing device based on the measured temperatures stored in the computing device. The method can also include the step 210 of determining whether the calculated rate of change in temperature exceeds a programmed first threshold. The method can also include the step 212 of turning off power to the heating apparatus when a temperature increase above the first threshold is detected in the structure.

Another step of the method can include turning on power to the heating apparatus when a temperature decrease below a second threshold is detected in the structure.

Another optional step 214 of the method can include flashing a visual display on a control panel or on a projection screen of the fireplace insert when power to the heating apparatus has been turned off or disabled.

Another step of the method can include preventing overheating and power usage when a concealing panel of the structure is configured in a concealed configuration so as to conceal the electric fireplace insert when the electric fireplace insert is not in use.

If the a temperature increase above the first threshold is not detected by step 210, then the heating apparatus will continue to have power supplied to it and be enabled and the temperature measurement cycle can be restarted and repeated 216 continuously unless and until a temperature increase above the first threshold is detected.

The invention also relates to a method that be used for controlling power to a heating apparatus of an electric fireplace insert. The method can include the step of providing a structure in which an electric fireplace insert is installed, wherein the electric fireplace insert includes a heating apparatus for generating heat and a disabling device for detecting changes in temperature. The method can also include the step of measuring a temperature at a location inside the structure at periodic intervals of time using the disabling device. The method can also include the step of turning off power to the heating apparatus when a temperature at or above a first threshold is detected in the structure.

Another step of the method can include turning on power to the heating apparatus when a temperature at or below a second threshold is detected in the structure.

Another step of the method can include preventing overheating and power usage when a concealing panel of the structure is configured in a concealed configuration so as to conceal the electric fireplace insert when the electric fireplace insert is not in use.

The invention also relates to a method that can be used for controlling power to a heating apparatus of an electric fireplace insert. The method can include the step of installing an electric fireplace insert inside an opening of a furniture apparatus, wherein the furniture apparatus includes a fireplace compartment formed within to receive the installed electric fireplace insert and a concealing panel that is removably installed proximal to the opening and is alternately configurable between a concealed configuration and an open configuration. The method can also include the step of configuring the concealing panel in the open configuration when a view is desired of simulated flames that are visible through the opening at a front surface of the electric fireplace insert, wherein power to a heating apparatus of the electric fireplace insert is turned on by a switch, which is communicatively connected to a disabling device, when the concealing panel is in the open configuration. The method can also include the step of configuring the concealing panel in the concealed configuration to at least partially cover the opening when concealment of the electric fireplace insert is desired, wherein power to the heating apparatus is turned off by the switch when the concealing panel is in the concealed configuration.

In this method, the switch can be installed on the furniture apparatus near to the opening, on the concealing panel, or on both. The switch can include a biased switch, a toggle switch, or a rotary switch. In one embodiment, the switch can include a magnetic proximity switch. In another embodiment, the switch can include an optical switch, for example, an infrared optical switch.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A combined furniture and heating device comprising:

a furniture apparatus comprising a fireplace compartment formed within an opening on at least one side of the furniture apparatus, at least one side feature located generally adjacent to the fireplace compartment, and a concealing panel for configuring the furniture apparatus into an open configuration or a concealed configuration; and a fireplace insert installed within the fireplace compartment of the furniture apparatus, the fireplace insert comprising a front surface at which flames are viewable when the concealing panel is placed in the open configuration;

a disabling device to turn on and turn off power to a heating apparatus that is located inside the fireplace insert;

wherein the disabling device turns off power to the heating apparatus when a temperature increase above a first threshold is detected in the combined furniture and heating device and turns on power to the heating apparatus when a temperature decrease below a second threshold is detected in the combined furniture and heating device;

wherein the first threshold is a rate of temperature increase determined over a first interval of time and wherein the second threshold is a rate of temperature decrease determined over a second interval of time; and wherein the concealing panel is removably installed proximal to the front surface of the fireplace insert and is alternately configurable in the concealed configuration to at least partially conceal the fireplace insert and the open configuration to reveal the front surface of the fireplace insert.

2. The device of claim 1, wherein the fireplace insert is an electric fireplace insert and wherein the flames are simulated.

3. The device of claim 1, wherein the disabling device turns off power to the heating apparatus after the concealing panel is configured in the concealed configuration and turns on power to the heating apparatus after the concealing panel is configured in the open configuration.

4. The device of claim 3, wherein the disabling device comprises at least one thermistor for detecting the temperature increase above the first threshold and the temperature decrease below the second threshold.

5. The device of claim 4, wherein the thermistor is a negative temperature coefficient (NTC) thermistor.

6. The device of claim 1, wherein the first threshold is a specific or approximate first temperature level and wherein the second threshold is a specific or approximate second temperature level.

7. The device of claim 1, wherein the disabling device comprises a switch.

8. The device of claim 7, wherein the switch comprises a contact switch, a magnetic proximity switch, or an optical switch.

9. The device of claim 1, wherein the disabling device is located inside the furniture apparatus.

10. The device of claim 1, wherein the disabling device is located inside the fireplace insert.

11. A combined furniture and heating device comprising:

a furniture apparatus comprising a fireplace compartment formed within an opening on at least one side of the furniture apparatus, and a concealing panel for configuring the furniture apparatus into an open configuration or a concealed configuration;

a fireplace insert installed within the fireplace compartment of the furniture apparatus, the fireplace insert comprising a front surface at which flames are viewable when the concealing panel is placed in the open configuration;

a disabling device to turn on and turn off power to a heating apparatus that is located inside the fireplace insert; and a computing device that stores data related to temperature measurements detected and recorded at periodic intervals by the disabling device and that calculates a rate of change, either increase or decrease, in temperature over an interval of time comprising at least some of the period intervals at which temperature measurements were detected and recorded, wherein the computing device receives information detected by the disabling device; and wherein the concealing panel is removably installed proximal to the front surface of the fireplace insert and is alternately configurable in the concealed configuration to at least partially conceal the fireplace insert and the open configuration to reveal the front surface of the fireplace insert, and wherein the disabling device is at least one of comprised by the computing device or a separate device as the computing device.

12. The device of claim 1, wherein the furniture apparatus comprises a furniture item selected from the group consisting of: a media console or media cabinet, a television stand, a cabinet, a dresser, a bureau, a chest of drawers, a nightstand, a wardrobe cabinet, a bookcase, a desk, a credenza, a buffet cabinet, a china cabinet, a pantry cabinet, a chest, a trunk, a headboard of a bed, a footboard of a bed, and any other suitable furniture item comprising sufficient space within which the furniture compartment may be formed for containing the fireplace insert.

13. The device of claim 1, wherein the concealing panel comprises at least one door attached to the furniture apparatus by one or more hinges and capable of closing to cover the opening so as to conceal the fireplace insert.

14. The device of claim 1, wherein the concealing panel comprises at least one sliding door movable within at least one track installed on the furniture apparatus and capable of closing to cover the opening so as to conceal the fireplace insert.

15. The device of claim 1, wherein the concealing panel comprises a removable panel that is capable of being placed over the opening so as to conceal the fireplace insert.

16. The device of claim 1, wherein the concealing panel is constructed from materials and in colors that are the same as or that match the materials and colors of the furniture apparatus.

17. A concealable electric fireplace system comprising:

a furniture apparatus comprising a fireplace compartment formed within an opening on at least one side of the furniture apparatus, at least one additional opening comprising a recessed shelf or drawer, and a concealing panel for configuring the furniture apparatus into an open configuration in which the opening is covered or a concealed configuration in which the opening is not covered;

an electric fireplace insert installed within the fireplace compartment of the furniture apparatus, the electric fireplace insert comprising a front surface at which simulated flames are viewable when the concealing apparatus is placed in the open configuration;

a disabling device to turn on and turn off power to a heating apparatus that is located inside the electric fireplace insert;

a computing device that stores data related to temperature measurements detected and recorded at periodic intervals by the disabling device and that calculates a rate of change, either increase or decrease, in temperature over an interval of time comprising at least some of the period intervals at which temperature measurements were detected and recorded, wherein the computing device receives information detected by the disabling device; and wherein the concealing panel is removably installed proximal to the front surface of the electric fireplace insert and is alternately configurable in the concealed configuration to at least partially conceal the electric fireplace insert and the open configuration to reveal the front surface of the electric fireplace insert.

18. The device of claim 17, wherein the disabling device turns off power to the heating apparatus after the concealing panel is configured in the concealed configuration and turns on power to the heating apparatus after the concealing panel is configured in the open configuration.

19. The device of claim 17, wherein the disabling device turns off power to the heating apparatus when a temperature increase above a first threshold is detected in the combined furniture and heating device and turns on power to the heating apparatus when a temperature decrease below a second threshold is detected in the combined furniture and heating device.

20. The device of claim 19, wherein the disabling device comprises at least one negative temperature coefficient (NTC) thermistor for detecting the temperature increase above the first threshold and the temperature decrease below the second threshold.

21. A concealable electric fireplace system comprising:

a furniture apparatus comprising a fireplace compartment formed within an opening on at least one side of the furniture apparatus, and a concealing panel for configuring the furniture apparatus into an open configuration in which the opening is covered or a concealed configuration in which the opening is not covered;

an electric fireplace insert installed within the fireplace compartment of the furniture apparatus, the electric fireplace insert comprising a front surface at which simulated flames are viewable when the concealing apparatus is placed in the open configuration;

a disabling device to turn on and turn off power to a heating apparatus that is located inside the electric fireplace insert;

a computing device that stores data related to temperature measurements detected and recorded at periodic intervals by the disabling device and that calculates a rate of change, either increase or decrease, in temperature over an interval of time comprising at least some of the period intervals at which temperature measurements were detected and recorded, wherein the computing device receives information detected by the disabling device; and wherein the concealing panel is removably installed proximal to the front surface of the electric fireplace insert and is alternately configurable in the concealed configuration to at least partially conceal the electric fireplace insert and the open configuration to reveal the front surface of the electric fireplace insert, and wherein the disabling device is at least one of comprised by the computing device or a separate device as the computing device.

22. The device of claim 17, wherein the furniture apparatus comprises a furniture item selected from the group consisting of: a media console or media cabinet, a television stand, a cabinet, a dresser, a bureau, a chest of drawers, a nightstand, a wardrobe cabinet, a bookcase, a desk, a credenza, a buffet cabinet, a china cabinet, a pantry cabinet, a chest, a trunk, a headboard of a bed, a footboard of a bed, and any other suitable furniture item comprising sufficient space within which the furniture compartment may be formed for containing the fireplace insert.

23. A concealable electric fireplace system comprising:

a furniture apparatus comprising a fireplace compartment formed within an opening on at least one side of the furniture apparatus, at least one drawer, and a concealing panel for configuring the furniture apparatus into an open configuration or a concealed configuration, wherein a front of the concealing panel visually accents a front of the least one drawer;

an electric fireplace insert installed within the fireplace compartment of the furniture apparatus, the electric fireplace insert comprising a front surface at which simulated flames are viewable when the concealing apparatus is placed in the open configuration; and a disabling device installed inside the electric fireplace insert to turn on and turn off power to a heating apparatus that is located inside the electric fireplace insert, wherein the disabling device comprises at least one thermistor, and wherein the disabling device turns off power to the heating apparatus when a temperature increase above a first threshold is detected by the at least one thermistor in the combined furniture and heating device and turns on power to the heating apparatus when a temperature decrease below a second threshold is detected by the at least one thermistor in the combined furniture and heating device;

wherein the first threshold is a rate of temperature increase determined over a first interval of time and wherein the second threshold is a rate of temperature decrease determined over a second interval of time; and wherein the concealing panel is removably installed proximal to the front surface of the electric fireplace insert and is alternately configurable in the concealed configuration to at least partially conceal the electric fireplace insert and the open configuration to reveal the front surface of the electric fireplace insert.

24. A concealable electric fireplace system comprising:

a furniture apparatus comprising a fireplace compartment formed within an opening on at least one side of the furniture apparatus, and a concealing panel for configuring the furniture apparatus into an open configuration or a concealed configuration;

an electric fireplace insert installed within the fireplace compartment of the furniture apparatus, the electric fireplace insert comprising a front surface at which simulated flames are viewable when the concealing apparatus is placed in the open configuration;

a disabling device installed inside the electric fireplace insert to turn on and turn off power to a heating apparatus that is located inside the electric fireplace insert, wherein the disabling device comprises at least one thermistor, and wherein the disabling device turns off power to the heating apparatus when a temperature increase above a first threshold is detected by the at least one thermistor in the combined furniture and heating device and turns on power to the heating apparatus when a temperature decrease below a second threshold is detected by the at least one thermistor in the combined furniture and heating device;

a computing device that stores data related to temperature measurements detected and recorded at periodic intervals by the disabling device and that calculates a rate of change, either increase or decrease, in temperature over an interval of time comprising at least some of the period intervals at which temperature measurements were detected and recorded, wherein the computing device receives information detected by the disabling device, and wherein the concealing panel is removably installed proximal to the front surface of the electric fireplace insert and is alternately configurable in the concealed configuration to at least partially conceal the electric fireplace insert and the open configuration to reveal the front surface of the electric fireplace insert wherein the disabling device is at least one of comprised by the computing device or a separate device as the computing device.

25. The device of claim 23, wherein the furniture apparatus comprises a furniture item selected from the group consisting of: a media console or media cabinet, a television stand, a cabinet, a dresser, a bureau, a chest of drawers, a nightstand, a wardrobe cabinet, a bookcase, a desk, a credenza, a buffet cabinet, a china cabinet, a pantry cabinet, a chest, a trunk, a headboard of a bed, a footboard of a bed, and any other suitable furniture item comprising sufficient space within which the furniture compartment may be formed for containing the fireplace insert.

26. A method for concealing an electric fireplace comprising the steps of:

(a) installing an electric fireplace insert inside an opening of a furniture apparatus, wherein the furniture apparatus comprises a fireplace compartment formed within to receive the installed electric fireplace insert, at least one side feature located generally adjacent to the fireplace compartment; and a concealing panel that is removably installed proximal to the opening and is alternately configurable between a concealed configuration and an open configuration;

(b) configuring the concealing panel in the open configuration when a view is desired of simulated flames that are visible through the opening at a front surface of the electric fireplace insert; and (c) configuring the concealing panel in the concealed configuration to at least partially cover the opening when concealment of the electric fireplace insert is desired, (d) turning off power to a heating apparatus installed inside the electric fireplace insert when a temperature increase above a first threshold is detected by a disabling device that controls power supplied to the heating apparatus; and (e) turning off power to the heating apparatus when a temperature decrease below a second threshold is detected by the disabling device.

27. The method of claim 26, wherein steps (b) and (c) of the method further comprise a step selected from the group consisting of:

(f) concealing the opening by closing the concealing panel, wherein the concealing panel comprises at least one door attached to the furniture apparatus by one or more hinges and is shaped and sized to be capable of closing to cover the opening so as to conceal the fireplace insert;

(g) concealing the opening by closing the concealing panel, wherein the concealing panel comprises at least one sliding door movable within at least one track installed on the furniture apparatus and is shaped and sized to be capable of closing to cover the opening so as to conceal the fireplace insert; and (h) concealing the opening by closing the concealing panel, wherein the concealing panel comprises a removable panel that is shaped and sized to be capable of being removably placed over the opening so as to conceal the fireplace insert.

28. The method of claim 26, further comprising the step of:

(i) turning off power to a heating apparatus installed inside the electric fireplace insert when the concealing panel is configured in the concealed configuration and an increase in temperature is detected by a disabling device that controls power supplied to the heating apparatus.

29. The method of claim 26, wherein the first threshold is a rate of temperature increase determined over a first interval of time and wherein the second threshold is a rate of temperature decrease determined over a second interval of time.

30. The device of claim 1, wherein the at least one side feature comprises at least one of a shelf, a drawer, a slot, or a door.

31. The device of claim 1, wherein the at least one side feature is located adjacent to and above or below the fireplace compartment.

32. The device of claim 1, wherein the at least one side feature is located adjacent to and to the right or left of the fireplace compartment.

33. The device of claim 1, wherein the fireplace insert further comprises at least one vent at the front surface, wherein the concealing panel is in the concealed configuration.

* * * * *